US007006051B2

(12) United States Patent
El-Mahdawy et al.

(10) Patent No.: US 7,006,051 B2
(45) Date of Patent: Feb. 28, 2006

(54) HORIZONTALLY POLARIZED OMNI-DIRECTIONAL ANTENNA

(75) Inventors: Ahmed El-Mahdawy, Gainesville, FL (US); Mark Hestness, Nora Springs, IA (US)

(73) Assignee: FRC Components Products Inc., Mason City, IA (US)

( * ) Notice: Subject to any disclaimer, the term of this patent is extended or adjusted under 35 U.S.C. 154(b) by 173 days.

(21) Appl. No.: 10/724,878

(22) Filed: Dec. 2, 2003

(65) Prior Publication Data

US 2005/0116874 A1 Jun. 2, 2005

(51) Int. Cl.
*H01Q 9/16* (2006.01)

(52) U.S. Cl. ..... 343/806; 343/700 MS; 343/835

(58) Field of Classification Search ..... 343/700 MS, 343/793, 795, 806, 810, 817, 818, 833, 834, 343/835

See application file for complete search history.

(56) References Cited

U.S. PATENT DOCUMENTS 6,211,840 B1 * 4/2001 Wood et al. ..... 343/793
6,249,260 B1 * 6/2001 Holloway ..... 343/795

* cited by examiner

*Primary Examiner*—Shih-Chao Chen
(74) *Attorney, Agent, or Firm*—Whitham, Curtis & Christofferson P.C.

(57) ABSTRACT

An antenna apparatus comprising bent dipoles and fed by a quarter-wave balun transformer with a single coaxial cable feed is disclosed. In this embodiment, the antenna elements are patterned onto a dielectric circuit board which is then mounted horizontally into a molded shell. The antenna is tuned by trimming the bent dipoles patterned on the circuit board.

14 Claims, 8 Drawing Sheets

HORIZONTALLY POLARIZED OMNI-DIRECTIONAL ANTENNA

BACKGROUND OF THE INVENTION

1. Field of the Invention

The present invention generally relates to a pair of bent dipole antennas fed with a single coaxial cable used to provide horizontally polarized, omni-directional coverage with a minimum amount of vertical cross-polarization for wireless communications.

2. Background Description

Antennas providing omni-directional coverage with a desired overhead "null' are typically vertical polarized "whip" antennas. Whip antennas are suitable for ground based fixed structures such as antenna towers. The mobile environment has necessitated the development of smaller more integrated antenna. Printed circuit board dipole antennas have been developed to meet this need. However, these newer, smaller antennas still commonly employ vertical polarization. As the frequency spectrum becomes more crowded, these vertically polarized systems increasingly suffer from noise susceptibility, due in part to man-made noise that is in the vertical direction. Likewise, multiple communications systems within the vertical polarized environment can cause significant interference. Communications systems are beginning to use horizontally polarized antennas to hide from the vertically polarized interference of other systems. However, maximum signal strength can only be achieved if all the antennas within the system have the same polarization.

One solution to meet this need is to use a pair of horizontally positioned bent dipoles to achieve omni-directional coverage with the overhead null. This can have nulls/peaks in the pattern greater than 3 dB. Additionally, other attempts to solve this problem have used antenna array circuits fed with complicated feed networks that may not be mechanically feasible in a mobile application or are difficult to manufacture. In addition, these solutions have relied on location of transmission line and related feed points with respect to the dipole in order to tune the antenna that is difficult to maintain during production.

SUMMARY OF THE INVENTION

It is an object of the present invention to improve reception/transmittance of horizontally polarized signals while minimizing the reception/transmittance of vertically polarized signals.

It is also an object of the present invention to minimize the amount of variation in the horizontal pattern to less than 1 dB such that it is omni-directional in nature.

It is also an object of the present invention to feed the antenna elements with only a single coaxial cable while providing tuning of the antenna independent of the transmission feed.

It is a further object of the present invention to package the antenna elements in such a manner as to offer a high-degree of environmental reliability in a "swept-back" aerodynamic shape.

According to the invention, the foregoing and other objects are achieved in part by having a pair of bent dipoles patterned onto a circuit board that is positioned horizontally atop a dielectric shell. The dipoles are fed 180° out of phase by a quarter-wave balun transformer preferably fed with a single coaxial cable feed. Matched capacitive and inductive components are placed in series with the feed to improve the broadband impedance match. Configuration of the dipoles on the dielectric substrate are such that they enable a tuning feature independent on the transmission feed location. The antenna is packaged within a structure that offers reliability in the mobile environment.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
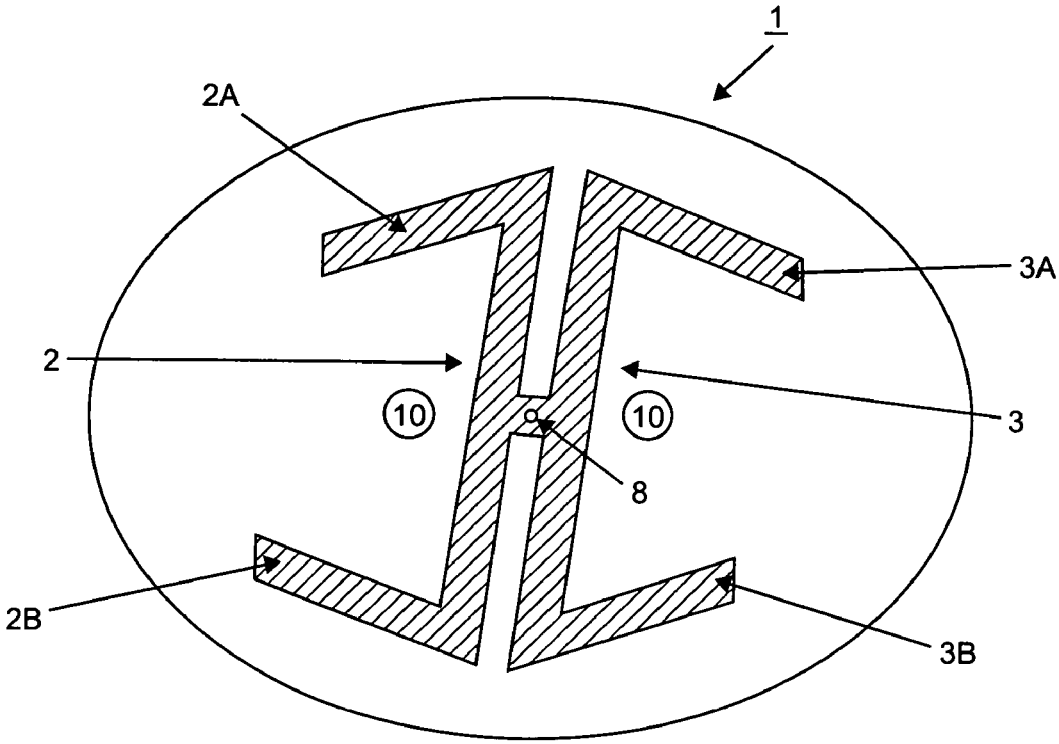
FIG. 1 is a bottom view of the circuit board showing the first half of the bent dipole elements.
Figure 2:
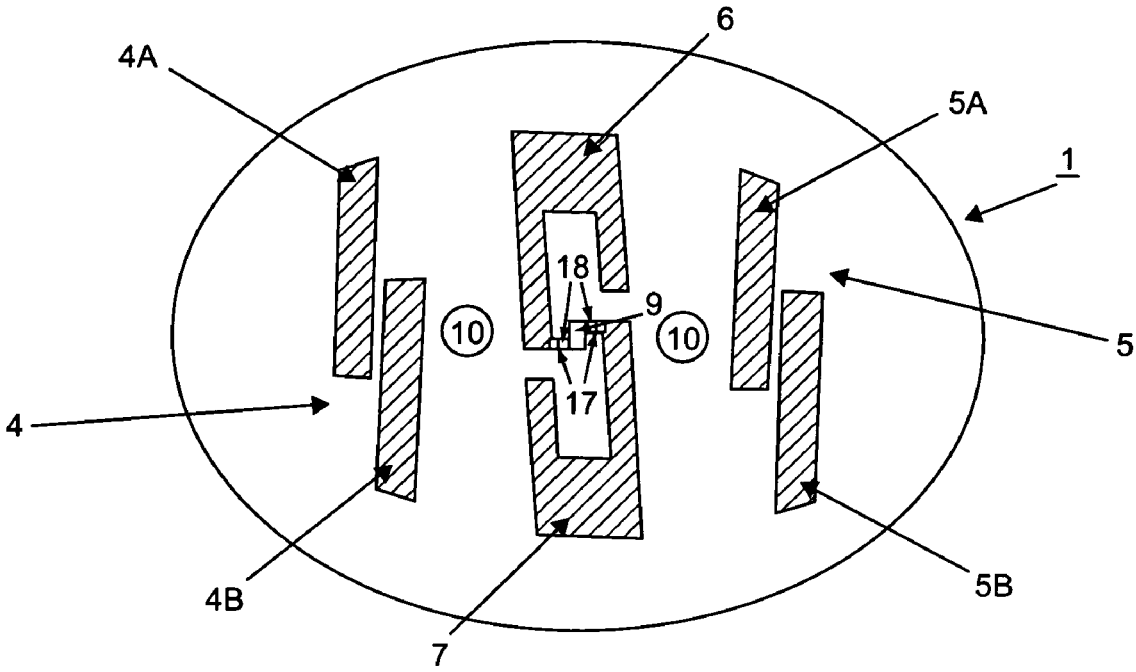
FIG. 2 is a top view of the circuit board showing the feed network, matching elements, and the second half of the bent dipole elements.
Figure 3:
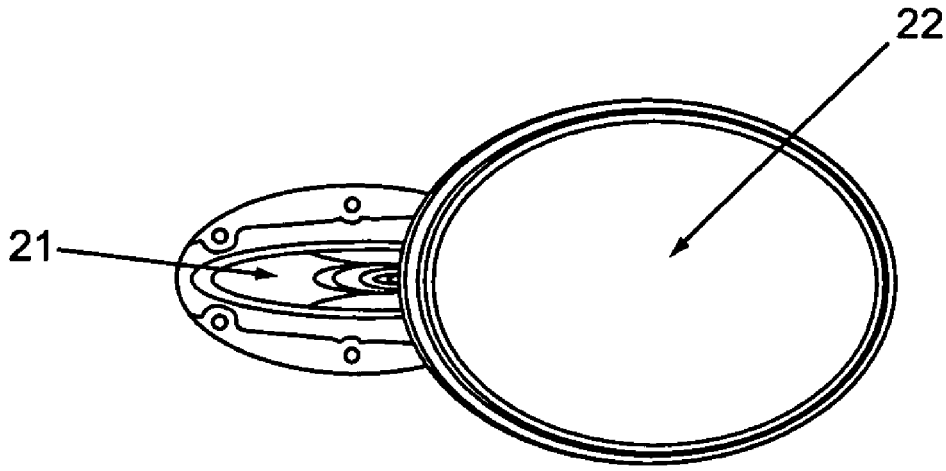
FIG. 3 shows a top view of the finished antenna package.
Figure 6:
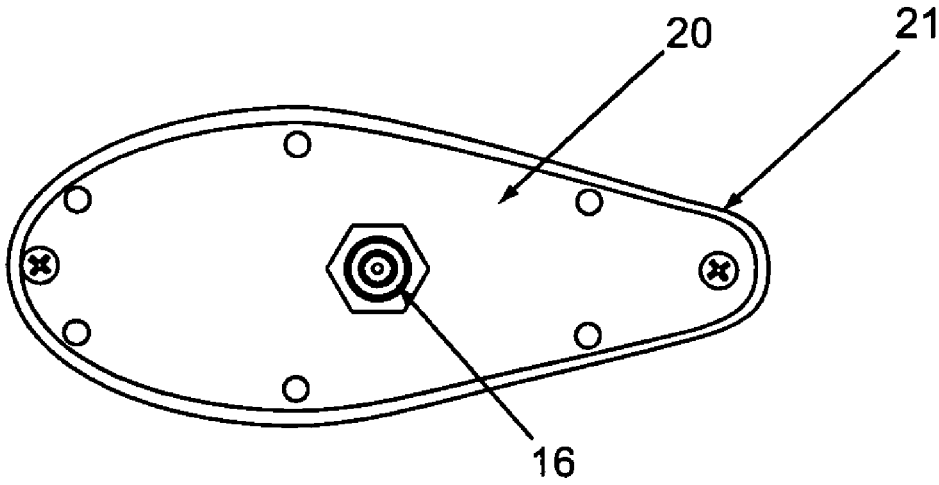
FIG. 6 shows a view of the antenna footprint.

Referring now to the drawings, FIGS. 1 and 2 show the dipole elements and feed network patterned onto a circuit board. The board consists of a dielectric substrate that is plated on both sides with a metalization. In an example of this embodiment, the board is 1/16" thick FR4 plated with 1 oz copper on both the top and bottom. FIG. 1 shows the metalization that is patterned onto the bottom of the circuit board 1, while FIG. 2 shows the metalization that is patterned onto the top of the circuit board 1. It should be understood that the metalization can be using other materials such as silver, tin, metal alloys, etc. and not be limited to copper.

FIG. 1 shows dipole elements 2 and 3 that are formed on the bottom of the circuit board 1. Elements 2 and 3 comprise the initial bent form of the dipole. Dipole element 2 has bent subelements 2A and 2B while dipole element 3 has bent subelements 3A and 3B. Dipole elements 2 and 3 are mirror images of each other and are joined together at the center of the circuit board 1 at ground plane 8. FIG. 2 shows the dipole elements 4 and 5 together with J shaped feed network elements 6 and 7 that are formed on the top of the circuit board 1. Dipole elements 4 and 5 are comprised of subelements 4A, 4B and 5A, 5B, respectively as shown in FIG. 2.

Dipole subelement 4A and dipole subelement 4B are positioned substantially perpendicular (e.g., angular relationship between 60° and 120°, and most preferably between 80° and 100°) to the bent elements 2A and 2B and dipole subelement 5A and dipole subelement 5B are positioned essentially perpendicular to the bent elements 3A and 3B. The dipole elements (2, 3, 4, and 5) are capacitively coupled through the dielectric substrate of the circuit board 1. Capacitively coupling bent elements 2 and 3 to dipole elements 4 and 5 rather than directly coupling them creates an electrically shorter antenna that enables dipole elements 4 and 5 to remain long, but still creates an antenna that is properly tuned. Bent subelement 2A is offset with respect to dipole subelement 5A. Bent subelement 2B is offset with respect to dipole subelement 5B. Bent subelement 3A is offset with respect to dipole subelement 4A. Bent subelement 3B is offset with respect to dipole subelement 4B. By having dipole elements 4 and 5 long, and by offsetting the bent subelement with the dipole subelement, and by keeping the length of bent subelements 2A, 2B, 3A and 3B identical or substantially identical (e.g., within 80% and 100%), an "overlap" of subelements 2A, 2B, 3A and 3B with 4A, 4B, 5A and 5B, respectively is created. This fills in any ripples in the desired horizontal co-polarization field, creating an omni-directional pattern with less than 1 dB of variation.

The dipole elements (2, 3, 4, 5, 6 and 7) are preferably fed by a single 50 ohm coaxial cable 15 with a quarter-wave sleeved balun assembly 11. The coaxial cable 15 is terminated away from the board with a female type TNC connector 16, however it should be understood that other connectors types could be used.

Figure 4:
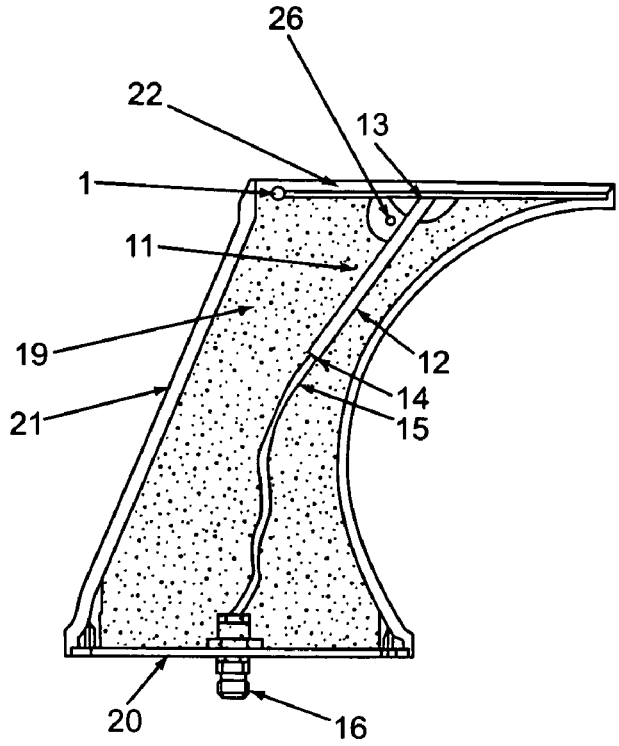
FIG. 4 shows a cutaway side view of the finished antenna package.
Figure 5:
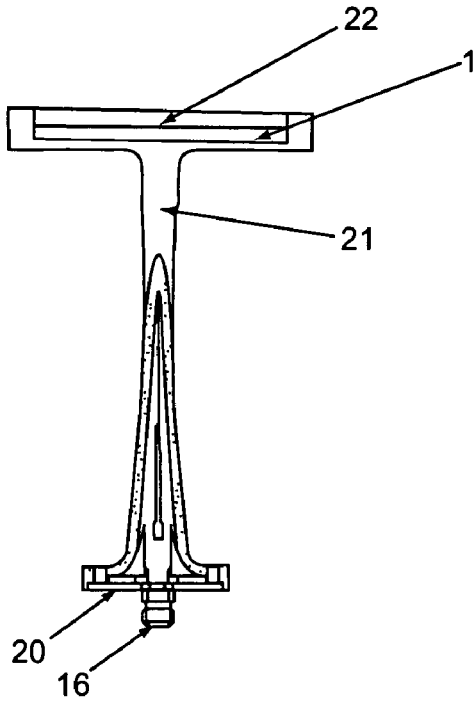
FIG. 5 shows a cutaway front view of the finished antenna package.

Adequate cross-polarization is achieved using the sleeved balun assembly 11 in combination with the dual J shaped elements 6 and 7 of the antenna feed network, which have been optimized in width to achieve the maximum bandwidth. Each J shaped element (6 and 7) is laid out in a clockwise manner relative to the dipole elements. The sleeved balun assembly 11 is a quarter-wave long, small diameter tube 12 that is placed over the shield of the coaxial cable 15 and terminated to the shield of the coaxial cable 15 at the end away from the circuit board 1 using a shorting plug 14, and isolated at the end closest to the circuit board 1 using insulating plug 13. The shield of the coaxial cable 15 is then terminated at ground plane 8, while the center conductor of the coaxial cable 15 continues though the circuit board substrate to connect at coaxial conductor connection 9. Using the sleeved balun assembly 11 in this fashion forces electrical current that develops on the outer shield of the coaxial cable 15 to be "re-routed" and not transmitted out as vertically polarized energy. Physical constraints of the antenna apparatus require that the balun sleeved assembly 11 be angled with respect to the circuit board. A minimum angle of approximately 55° (shown as 26 in FIG. 4) should be maintained for proper cross-polarization.

FIG. 2 also shows the antenna feed network which comprises substantially identical inductive elements 17 and capacitive elements 18 (in this embodiment, high frequency chip inductors and capacitors) placed in series between the coaxial conductor connector 9 and each leg of the J shaped elements 6 and 7.

Figure 7A:
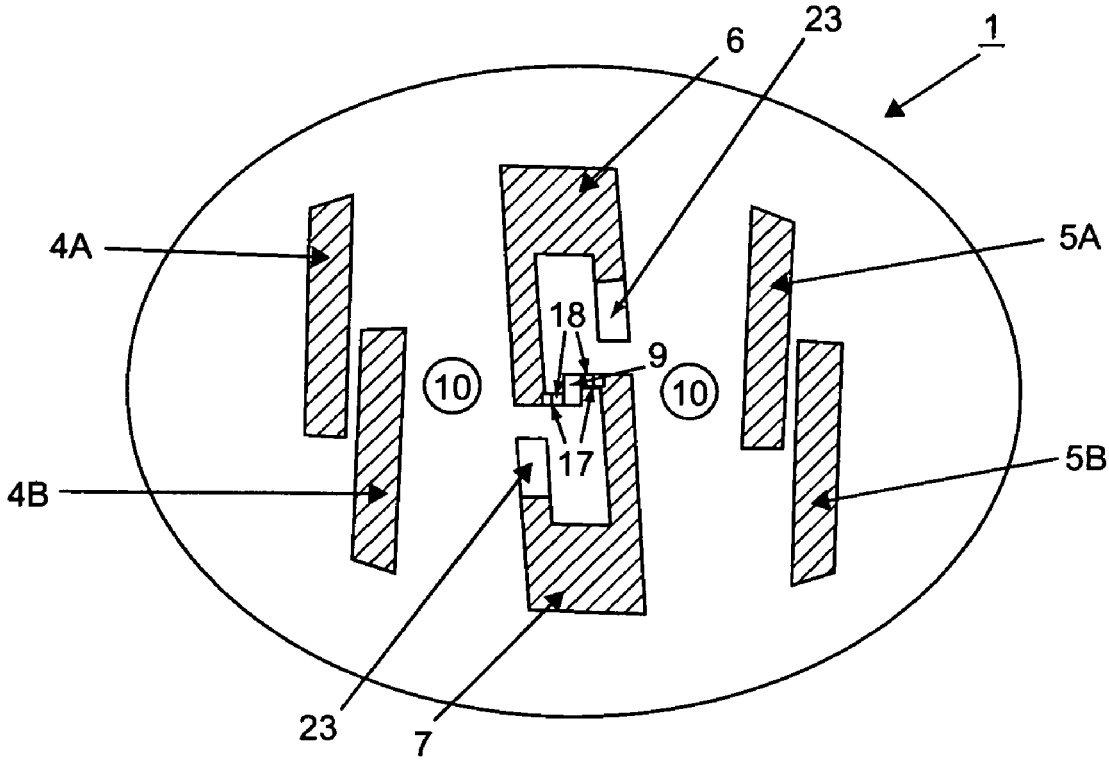
FIGS. 7A, 7B, and 7C illustrates various methods of tuning the antenna.
Figure 7B:
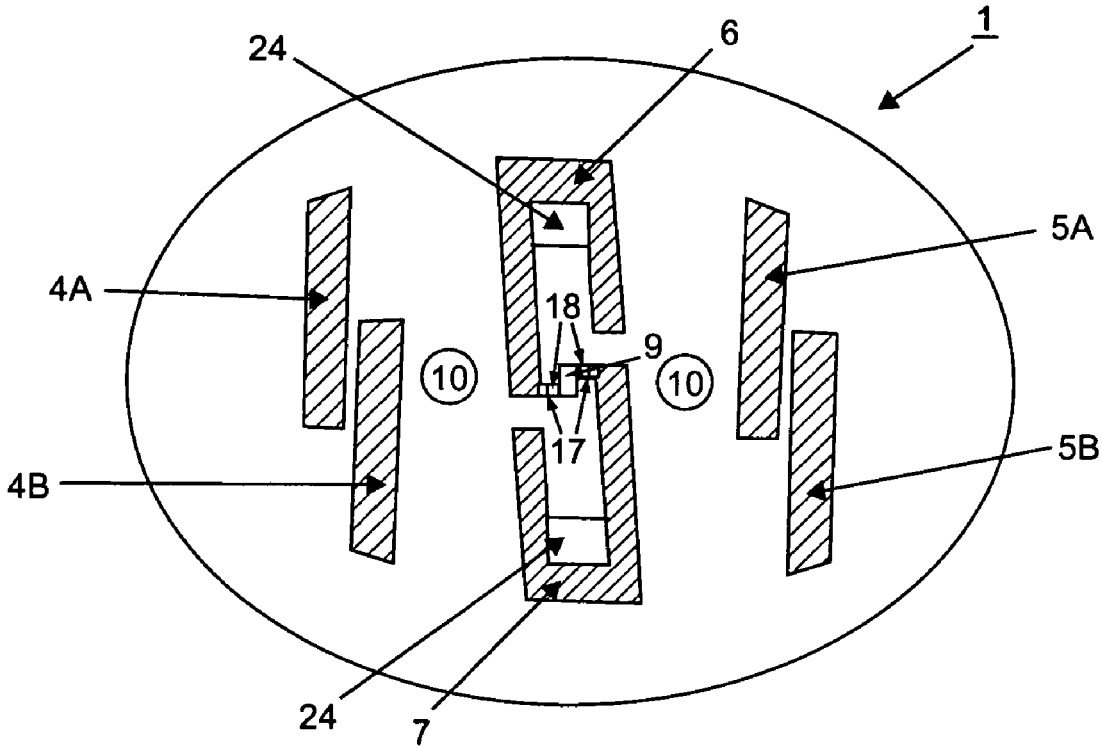
Figure 7C:
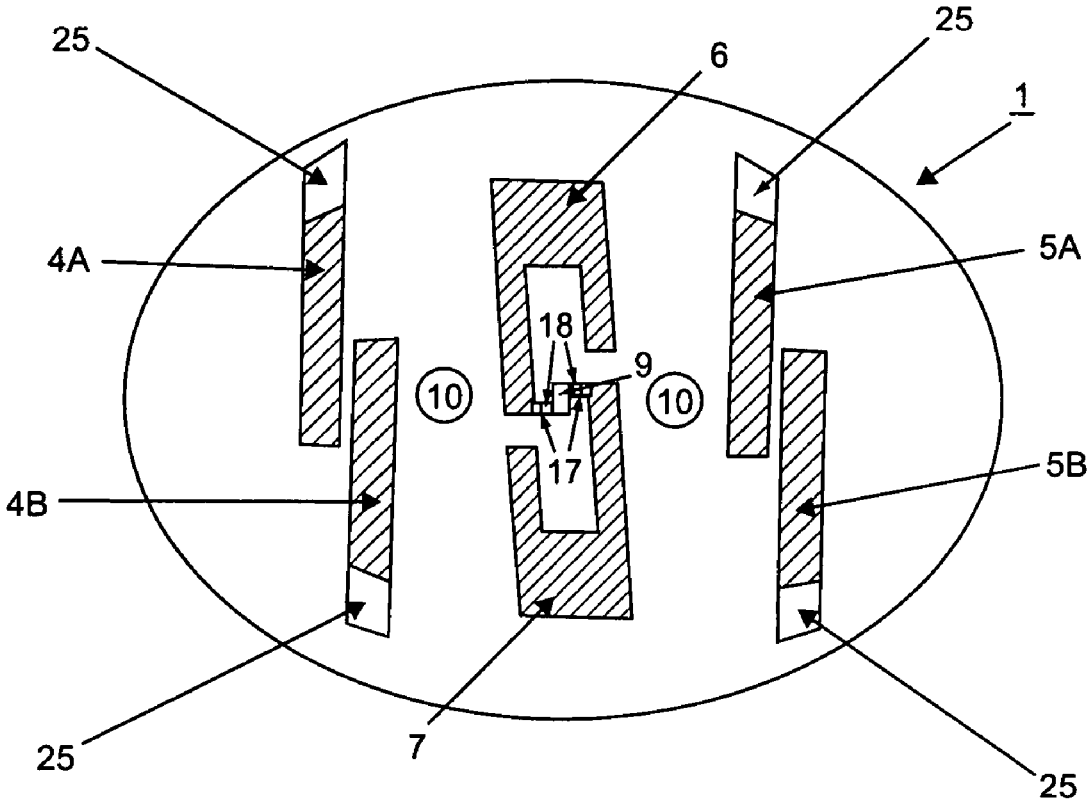

FIGS. 7A, 7B, and 7C show several different methods of tuning the antenna. Trimming away the metalization on the open ends (see items 23) of the J shaped elements 6 and 7 shown in FIG. 7A will electrically shorten the antenna, increasing its operating frequency. This electrical shortening can also be accomplished by trimming the "squared-off" ends of elements 4A, 4B, 5A and 5B. In the latter case, the elements must be trimmed equal amounts to maintain proper balance in the omni-directional radiation pattern. This is also true-though to a lesser extent-when trimming elements 6 and 7. FIG. 7B shows the tuning method associated with trimming the inside "fat" area (see item 24 on FIG. 7B) of J shaped elements 6 and 7 which has the effect of electrically lengthening the antenna, lowering the operating frequency. The "fat" area 24 is thought of as the section of J shaped elements 6 and 7 that runs parallel to the long axis of the circuit board 1 and is thicker in width than the ends of the J shaped elements 6 and 7. A third, and less desirable method of tuning is shown in FIG. 7C which would be to add conductive tape (see items 25 on FIG. 7C) or a similar item to physically lengthen elements 4A, 4B, 5A and 5B. The antenna can also be tuned by changing the values of the inductive elements 17 and capacitive elements 18. Selection of inductive elements 17 and capacitive elements 18 values will 'coarse' tune the operating frequency and does not "fine" tune the antenna. Values of C1/C2 and L1/L2 must be substantially identical in order to maintain the proper omni-directional radiation pattern. In this embodiment, the value of L1 & L2 is 12 nH and the value of C1/C2 is 2 pF. One final thing that will affect the antenna tuning is thickness of the circuit board dielectric. Since elements 2A, 2B, 3A and 3B are capacitively coupled to elements 24A, 4B, 5A and 5B via the board dielectric, any changes in the board thickness will cause the antenna to appear electrically longer (thinner board) or shorter (thicker board). Thus, the thickness of the board is fairly critical, although slight variations of a few mils can easily be compensated for using the above methods. It should be understood that the antenna can be tuned during manufacturing by varying the thickness of the circuit board.

FIGS. 3–6 show an embodiment of the antenna apparatus and footprint. In this embodiment, the antenna apparatus is a one piece foam 19 filled plastic shell 21 that is enclosed by bonding a metal baseplate 20 to the bottom and a plastic cap 22 to the top. Both the plastic shell 21 and plastic cap 22 are injection molded plastic with final finishing and aesthetics. Holes 10 in the circuit board allow foam 19 to pass through the circuit board 1 to encapsulate the upper surface of the circuit board 1 and tuning components. Both the antenna apparatus plastic shell 21 and foam 19 will affect the tuning of the antenna, so material selection is important, although proper before/after data collection will help to compensate for any adverse effects in the tuning.

Figure 8:
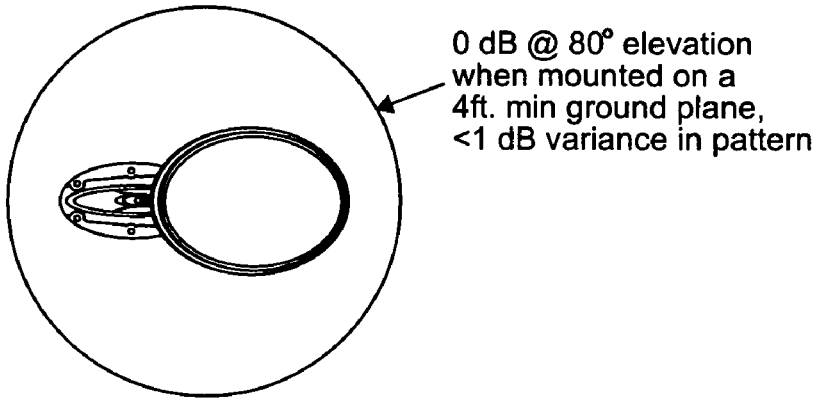
FIG. 8 shows the overhead plane radiation pattern.
Figure 9:
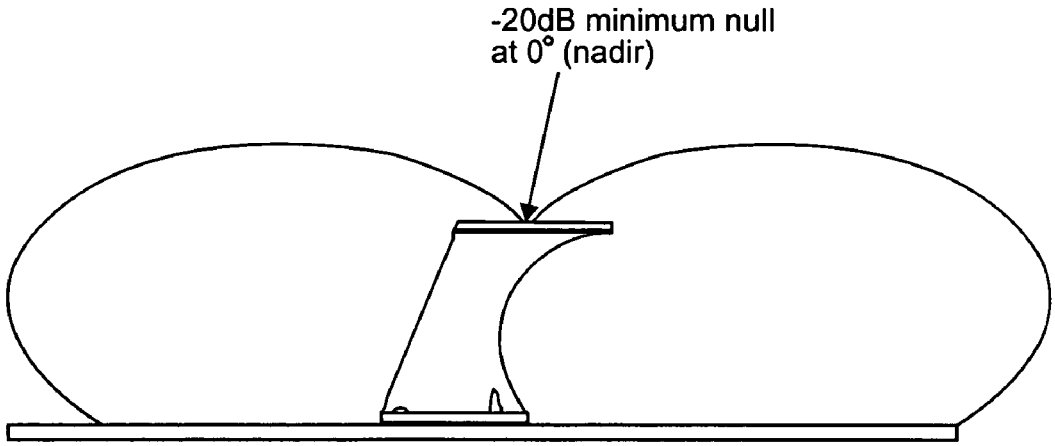
FIG. 9 shows the side view radiation pattern.

FIG. 8 demonstrates a sample radiation pattern showing the omni-directional pattern in the horizontal plane. Also created by the bent dipole configuration is a "null" in the overhead or nadir direction. A sample vertical plane radiation pattern of this is shown in FIG. 9.

Although the present invention has been described in terms of the preferred embodiment, it is to be understood that various modifications and alterations can obviously be made to the existing structure (e.g., changes in the physical shape and material of the antenna apparatus, type and position of connector, etc.) Accordingly, it is intended that the appended claims be interpreted as covering all modifications and alterations as fall within the true spirit and scope of the invention.

While the invention has been described in terms of its preferred embodiment, those skilled in the art will recognize that the invention can be practiced with modification within the spirit and scope of the appended claims.

What we claim as new and desire to secure by Letters Patent is:

1. An antenna apparatus comprising:

a circuit board comprising a plurality of dipole antenna elements including inductive and capacitive elements, and a quarter-wave sleeved balun and coaxial cable feed assembly connected to said circuit board, and wherein said plurality of dipole elements comprise a first section and a second section, said first section is located on the bottom side of said circuit board, and said second section is located on the top side of said circuit board and is substantially perpendicular and capacitively coupled to said first sections, and said plurality of dipole elements are laterally offset from each other to create an overlapping of the capacitively coupled elements, and wherein said inductive and capacitive elements are in series with a pair of J shaped elements, and said pair of J shaped elements are patterned onto the circuit board in a clockwise direction, wherein, a first J shaped element is starting to the left and a second J shaped element is starting to the right of said quarter-wave sleeved balun and coaxial cable feed assembly.

2. The antenna apparatus according to claim 1, wherein a width of each J shaped element varies in that an area of said pair of J shaped elements that run parallel to the long axis of said circuit board is wider than the rest of the element.

3. The antenna apparatus according to claim 1, wherein:

said quarter-wave sleeved balun and coaxial cable feed assembly comprises a quarter-wave length long metal tube placed over said coaxial cable feed assembly, said quarter-wave sleeved balun is terminated to the coaxial cable shield at a point away from said circuit board, said quarter-wave sleeved balun is left unterminated at the end closest to said circuit board, said quarter-wave sleeved balun assembly is angled with respect to the circuit board at an minimum angle of approximately 55°, said coaxial cable feed assembly shield is terminated to the bottom side of said circuit board at the center of said dipole elements, and said coaxial cable feed assembly center conductor passes through the dielectric of the circuit board and is terminated to said J shaped elements through said inductive elements.

4. The antenna apparatus according to claim 1, wherein said circuit board is elliptically shaped.

5. A method for tuning an antenna apparatus comprising the steps of:

creating an circuit board comprising a plurality of dipole antenna elements, patterning a first section of said plurality of dipole antenna elements on the bottom side of said circuit board and a second section of said plurality of dipole antenna elements on the topside of said circuit board so that said second section is substantially perpendicular and capacitively coupled to said first sections, forming said second section of said plurality of dipole antenna elements as a pair of J shaped elements that are patterned onto said circuit board in a clockwise direction, wherein, a first J shaped element is starting to the left and a second J shaped element is starting to the right of said quarter-wave sleeved balun and coaxial cable feed assembly, and configuring said J shaped elements such that a width of each J shaped element is wider in that an area of said pair of J shaped elements that run parallel to the long axis of said circuit board.

6. The method for tuning an antenna apparatus according to claim 5, further comprising the steps of removing the metalization on the open end of said J shaped elements to electrically shorten said dipole antenna elements.

7. The method for tuning an antenna apparatus according to claim 5, further comprising the step of removing the metalization on the squared-offends of said dipole antenna elements to electrically shorten said dipole antenna elements.

8. The method for tuning an antenna apparatus according to claim 5, further comprising the step of removing the metalization on said wider area of said J shaped elements to electrically lengthen said dipole antenna elements.

9. The method for tuning an antenna apparatus according to claim 5, further comprising the step of adding metalization to the squared off ends of said dipole antenna elements to electrically lengthen said antenna apparatus.

10. The method for tuning an antenna apparatus according to claim 5, further comprising the step of varying the thickness of the circuit board, wherein:

a thinner circuit board causes the antenna apparatus to be electrically longer, and a thicker circuit board causes the antenna to be electrically shorter.

11. A method of manufacturing an antenna apparatus comprising the steps of:

creating a circuit board comprising a dielectric substrate and inductive and capacitive elements are in series with a pair of J shaped elements, forming a feed assembly from a single coaxial cable with a quarter-wave sleeved balun assembly, forming one piece antenna apparatus plastic shell, positioning a plastic cap as a top of said antenna apparatus plastic shell, placing said circuit board within said antenna apparatus plastic shell just below said plastic cap, oriented in the horizontal plane, bonding a metal baseplate to the bottom of said antenna apparatus plastic shell, connecting said feed assembly to said circuit board and terminating said feed assembly with a connector at said metal baseplate, and injecting a foam material to fill said antenna apparatus plastic shell and allowing said foam material to encapsulate the upper surface of said circuit board.

12. The method of manufacturing an antenna apparatus as recited in claim 11 further comprising the step of:

selecting a pair of capacitive elements such that said pair of capacitive are substantially identical.

13. The method of manufacturing an antenna apparatus as recited in claim 11 further comprising the step of creating said circuit board to be approximately 1/16" thick FR4 plated on both the top and bottom.

14. The method of manufacturing an antenna apparatus as recited in claim 11 further comprising the step of selecting said foam material with respect the affect on tuning said antenna apparatus.

* * * * *